United States Patent [19]

Suzuki et al.

[11] 4,291,659

[45] Sep. 29, 1981

[54] AIR-FUEL RATIO CONTROL SYSTEM FOR AN INTERNAL COMBUSTION ENGINE

[75] Inventors: Mikio Suzuki; Toshifumi Nishimura, both of Yokosuka, Japan

[73] Assignee: Nissan Motor Company, Limited, Yokohama, Japan

[21] Appl. No.: 103,718

[22] Filed: Dec. 14, 1979

[30] Foreign Application Priority Data

Dec. 28, 1978 [JP] Japan ..... 53-161960

[51] Int. Cl.[3] ..... F02M 7/12; F02M 1/10; F02B 75/10

[52] U.S. Cl. ..... 123/440; 123/589

[58] Field of Search ..... 123/440, 489, 589, 588; 60/276, 285

[56] References Cited

U.S. PATENT DOCUMENTS

| | | | |
|---|---|---|---|
| 4,111,010 | 9/1978 | Minami | 60/276 |
| 4,122,809 | 10/1978 | Iwasa | 123/440 |
| 4,167,924 | 9/1979 | Carlson et al. | 123/440 |
| 4,215,656 | 8/1980 | Manaka et al. | 123/440 |
| 4,223,651 | 9/1980 | Eshelman et al. | 60/276 X |
| 4,252,098 | 2/1981 | Tomczak et al. | 123/446 X |

*Primary Examiner*—Tony M. Argenbright

[57] ABSTRACT

The air-fuel ratio for an internal combustion engine is controlled at the three stages: (A) when the engine temperature is lower than a first predetermined value, the air-fuel ratio is controlled only by a choke valve, (B) when the engine is at a temperature of the first predetermined value to a second predetermined value, the air-fuel ratio is controlled according to the output signals of engine temperature detecting means, and (C) when the engine temperature is higher than the second predetermined value, the air-fuel ratio is controlled according to the signals from air-fuel ratio detecting means.

9 Claims, 2 Drawing Figures

AIR-FUEL RATIO CONTROL SYSTEM FOR AN INTERNAL COMBUSTION ENGINE

BACKGROUND OF THE INVENTION

The present invention relates to an air-fuel ratio control system for an internal combustion engine.

In general, a desired air-fuel mixture must be rich at the engine starting when it is cold, or during the warming up thereafter because the engine stability must be obtained. After the warming up, the air-fuel mixture can be maintained lean.

In a prior art electronic control type carburetor, a conventional choke valve mechanism is provided in the carburetor to enrich the air-fuel ratio when the engine is cold. Otherwise, the feedback control for the electronic control type carburetor could not be carried out to stabilize the engine operation. For example, the output of an $O_2$ sensor is not enough because the exhaust temperature rises insufficiently.

According to such an choke valve mechanism, the actual air-fuel ratio is determined by the combination of the vacuum produced by the air flow through the venturi and the vacuum produced by the throttle resistance of the choke valve. In addition, the turbulent flow of the air caused by the choke valve passes through a nozzle portion. Thus, the vacuum near the nozzle portion is not necessarily in proportion to the actual air flow. For such a reason, the actual air-fuel ratio cannot become the desired air-fuel ratio so that a lot of CO, HC and the like in the exhaust gases are exhausted into the atmosphere. This results in the fuel cost increase.

SUMMARY OF THE INVENTION

Therefore, it is an object of the present invention to provide an air-fuel control system for an internal combustion engine in which the foregoing defects of the prior art can be overcome.

Another object of the present invention is to provide an air-fuel electronic control system for an internal combustion engine in which the feedback control can be carried out on the basis of the output signals of an engine temperature detecting means so as to decrease the quantity of CO, HC or the like in the exhaust gases to be exhausted into the atmosphere thereby to decrease the fuel cost.

According to the present invention, an air-fuel ratio control system includes means for detecting the temperature of an engine after its cold starting in addition to means for detecting the concentrations of the exhaust gases coming from the engine. The air-fuel ratio is controlled at the three different stages, (A) when the engine temperature is lower than a first predetermined value, the air-fuel ratio is controlled only by a choke valve, (B) when the engine is at a temperature of said first predetermined value to a second predetermined value, the air-fuel ratio is controlled according to the output signals of said engine temperature detecting means, and (C) when the engine temperature is higher than said second predetermined value, the air-fuel ratio is controlled according to the signals from the exhaust gas detecting means.

BRIEF DESCRIPTION OF THE DRAWINGS

These and other objects, features and advantages of the present invention will become more apparent from the following detailed description of the preferred embodiment thereof when read in conjunction with the accompanying drawings in which.

DETAILED DESCRIPTION OF THE PREFERRED EMBODIMENT

Figure 1:
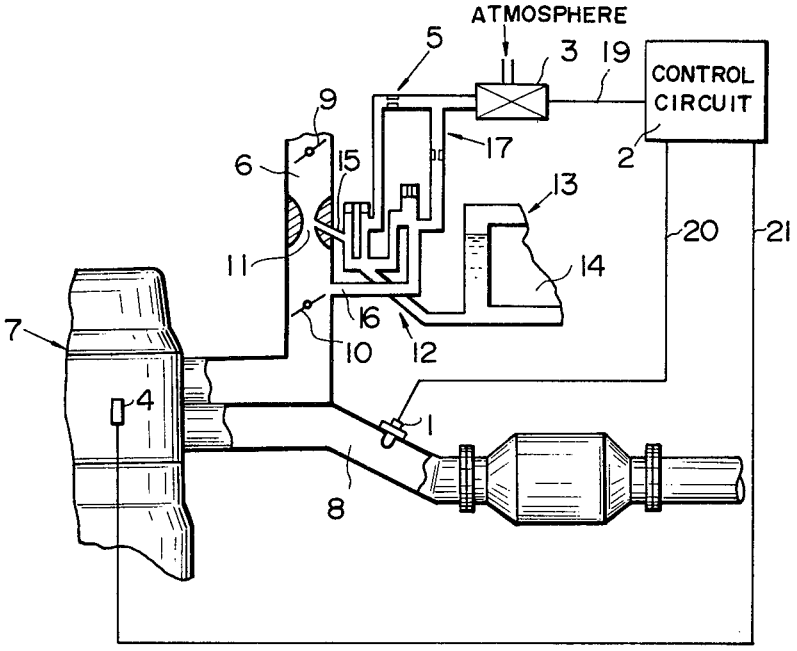
FIG. 1 is a schematic explanation view showing an air-fuel ratio control system for an internal combustion engine according to the present invention.

Referring now to the drawings, FIG. 1 shows an air-fuel ratio control system for an internal combustion engine according to a preferred embodiment of the present invention. The reference numeral 1 denotes an exhaust gas sensor, 2 a control circuit, 3 an air-fuel ratio control valve, 4 a temperature sensor, and 5 a carburetor. The carburetor 5 may be of a conventional construction. The intake passage 6 leads to the engine which is generally designated by the numeral 7. The conventional exhaust passage 8 communicates with the engine 7 in a well-known manner. The exhaust gas sensor 1 is provided on a proper portion of the exhaust passage 8. The exhaust gas sensor 1 may be of a well-known construction as can function in a conventional manner. The choke valve 9 and the throttle valve 10 are provided in the intake passage 6. The venturi portion 11 is positioned between the throttle valve 10 and the choke valve 9 for sucking the fuel through the fuel passage means 12 from the fuel reservoir assembly 13 including the float 14. The fuel passage means 12 includes the nozzle 15 open to the venturi portion 11 and bypass port 16 open to the intake passage 6 near the throttle valve 10. The fuel passage means 12 further comprises the air bleed means 17 leading to the atmosphere via the air-fuel ratio control valve 3.

As well-known to those skilled in the art, the fuel from the fuel reservoir assembly 13 is mixed with the air coming from the air bleed means 17 and thereafter passes through the nozzle 15 and/or the bypass port 16 into the intake passage 6 to become the desired combustible air-fuel mixture.

The air-fuel ratio control valve 3 is electrically connected through the line 19 to the control circuit 2 and actuated thereby if required so as to increase or decrease the air flow from the atmosphere into the air bleed means 17 leading to the intake passage 6. The control circuit 2 is also connected to the exhaust gas sensor 1 and the temperature sensor 4 through the lines 20 and 21, respectively.

The exhaust gas sensor 1 functions as an air-fuel ratio detecting device so as to detect the concentrations of the exhaust gases such as $O_2$, CO, HC, $NO_x$ and the like flowing through the exhaust passage 8.

The air-fuel ratio control valve 3 can be replaced by another type actuator. Preferred examples of the air-fuel ratio control valve 3 are an electromagnetic valve, a valve equipped with a diaphragm, a servo-motor actuation type valve and the like. In the illustrated embodiment, the valve 3 can control the air flow in such a way that the total air-fuel ratio can converge on the theoretical air-fuel ratio according to the signals of the control circuit 2.

The temperature sensor 4 may be a sensor for detecting the water or oil so as to detect indirectly the engine temperature. The temperature sensor 4 can be provided on any suitable portion where the temperature thereof changes in proportion to the engine temperature, for example, a component of the engine, or the water for cooling the engine.

The operation of the air-fuel ratio control system as noted above will be described.

At the cold engine starting, the desired air-fuel ratio must be rich. For example, when the temperature of the engine 7 is lower than 15° C. the air-fuel mixture must be enriched. In such a case, the air-fuel ratio is controlled only by the choke valve 9 while the air-fuel ratio control valve 3 is completely closed so that the feedback control by the exhaust gas sensor 1 and the temperature sensor 4 is not carried out.

When the engine temperature is within a predetermined range, the choke valve 9 is completely open while the air-fuel ratio control valve 3 is operated by the control circuit 2 on the basis of the output signals from the temperature sensor 4. For example, when the engine temperature is at a temperature of 15° C. to 55° C. during the warming up of the engine, the output signal of the temperature sensor is sent through the line 21 to the control circuit 2 so as to actuate the air-fuel ratio control valve 3 according to the signals thereby to increase the air flow into the air bleed means 17. The opening degree of the air-fuel ratio control valve 3 will increase from 0 to 50% in proportion to the engine temperature. When the engine temperature becomes 55° C., for example, then the feedback control on the basis of the signals from the temperature sensor 4 is automatically cut off. At the same time, the feedback control on the basis of the signals from the exhaust gas sensor 1 begins to be carried out in a conventional manner.

After the warming up of the engine, for example, when the temperature of the water for cooling the engine becomes 55° C. or more, the output signal of the exhaust gas sensor 1 is sent to the control circuit 2. The output signal is compared with a predetermined value thereby to operate the valve 3 for controlling the air-fuel ratio.

Figure 2:
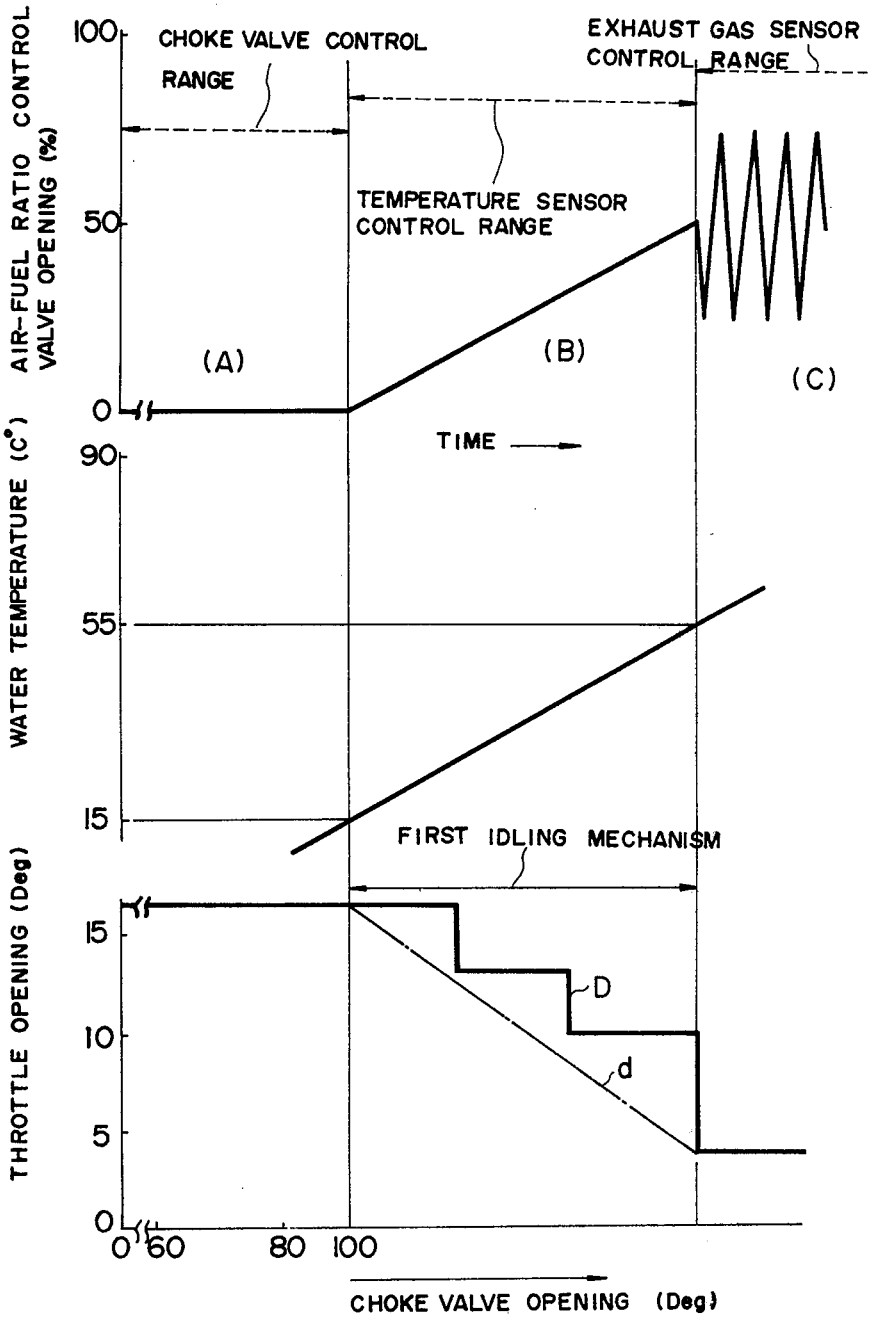
FIG. 2 illustrates the relationships among the opening of an air-fuel ratio control valve, the opening of a choke valve, the temperature of the water for cooling the engine and the opening of a throttle valve according to a preferred embodiment of the present invention. .

FIG. 2 shows an air-fuel ratio control method by the valve 3. As can be seen from FIG. 2, the air-fuel ratio is controlled as follows:

(A) When the engine temperature is lower than 15° C., the air-fuel ratio control valve 3 is completely closed. The air-fuel ratio is controlled by the choke valve 9 only.

(B) When the engine temperature is between 15° C. and 55° C., the choke valve 9 is completely open. The opening of the air-fuel control valve 3 is controlled by the control circuit 2 according to the output signal of the temperature sensor 4.

(C) When the engine temperature becomes 55° C., the output signal of the exhaust gas sensor 1 is sent to the control circuit 2 whereby the feedback control begins to be carried out by means of the exhaust gas sensor 1.

Thus, the air-fuel ratio is controlled at the three stages. The air-fuel ratio control of the choke valve is carried out only within the limited low temperature range as compared with the prior art.

FIG. 2 also shows that the opening of the throttle valve 10 is controlled step by step as denoted by the line D by means of a bimetal (not shown) in a conventional manner. Otherwise, the opening of the throttle valve 10 can be controlled continuously by means of a wax-pellet type thermostat (not shown) or the like in response to the warming up of the engine 7 as designated by the chain line d.

According to the present invention, the control accuracy of the air-fuel ratio after the cold engine starting can be remarkably improved so that the fuel consumption as well as the quantity of the exhaust gases such as CO, HC or the like can be decreased and the operational performance can be increased.

What is claimed is:

1. An air-fuel ratio control system for an internal combustion engine of an automotive vehicle, comprising:

an intake passage leading to the engine;

an exhaust passage communicating with the engine;

a choke valve provided in position in said intake passage;

a throttle valve provided in said intake passage;

venturi means positioned between said choke valve and said throttle valve in said intake passage for sucking the fuel including air bubbles;

means provided in said exhaust passage for detecting the air-fuel ratio;

means for detecting the engine temperature;

control means for receiving the output signals from said air-fuel ratio detecting means and said engine temperature detecting means to control on the basis thereof the air flow which will be mixed with the fuel, in such a way that the actual fuel-ratio is controlled at the three stages, that is, (A) when the engine temperature is lower than a first predetermined value, the air-fuel ratio is controlled only by said choke valve, (B) when the engine is at a temperature of said first predetermined value to a second predetermined value, said air-fuel ratio control means is actuated according to the output signals of said engine temperature detecting means so as to control the air-fuel ratio, and (C) when the engine temperature is higher than said second predetermined value, said air-fuel ratio control means is actuated according to the output signals from said air-fuel ratio detecting means so as to control air-fuel ratio.

2. An air-fuel ratio control system for an internal combustion engine of an automotive vehicle as defined in claim 1 wherein said control means includes means for controlling variably the opening of an air bleed leading to said intake passage.

3. An air-fuel ratio control system for an internal combustion engine of an automotive vehicle as defined in claim 1 wherein said control means includes an air-fuel ratio control valve for controlling the air flow to be fed into an air bleed leading to said intake passage, and a control circuit electrically connected to said air-fuel ratio control valve, said temperature detecting means and said air-fuel ratio detecting means, respectively, for actuating said air-fuel ratio control valve according to the signals from said temperature detecting means and said air-fuel ratio detecting means only when desired.

4. An air-fuel ratio control system for an internal combustion engine of an automotive vehicle as defined in claim 1 wherein said air-fuel ratio detecting means is an exhaust gas sensor provided on a proper portion of said exhaust passage for detecting the concentrations of the exhaust gases coming from the engine.

5. An air-fuel ratio electric control system for an internal combustion engine of an automotive vehicle, comprising:

a choke valve for controlling the air flow into the engine;

an exhaust gas sensor for detecting the concentrations of the exhaust gases coming from the engine;

a temperature sensor for detecting directly or indirectly the temperature of the engine; and control means for receiving the output signals from said temperature sensor so as to control the air-fuel ratio at the three stages, that is, (A) when the engine temperature is lower than a first predetermined value, the air-fuel ratio is controlled by only said choke valve, (B) when the engine is at a temperature between the first predetermined value and a second predetermined value, the air-fuel ratio is controlled by said control means according to the signals from said temperature sensor, and (C) when the engine temperature is higher than the second predetermined value, the air-fuel ratio is controlled by said control means according to the signals from said exhaust gas sensor.

6. An air-fuel ratio control system for an internal combustion engine of an automotive vehicle as defined in claim 5 wherein said control means includes means for controlling variably the opening of an air bleed leading to said intake passage.

7. An air-fuel ratio control system for an internal combustion engine of an automotive vehicle as defined in claim 5 wherein said control means includes an air-fuel ratio control valve for controlling the air flow to be fed into an air bleed leading to said intake passage, and a control circuit electrically connected to said air-fuel ratio control valve, said temperature sensor and said exhaust gas sensor, respectively, for actuating said air-fuel ratio control valve according to the signals from said temperature sensor and said exhaust gas sensor only when desired.

8. An air-fuel ratio control method for an internal combustion engine of an automotive vehicle, comprising the steps of:

detecting the temperature of the engine by a temperature sensor;

controlling the air-fuel ratio of the air-fuel mixture to be fed to the engine, only by means of a choke valve provided in an intake passage of a carburetor when the detected temperature of the engine is lower than a first predetermined value;

controlling the air-fuel ratio by an air-fuel ratio control valve which is actuated on the basis of the output signal only from the temperature sensor so as to control the air flow into an air bleed for mixing the air with the fuel to be sucked into the intake passage, when the engine temperature is between the first predetermined value and a second predetermined value higher than it, the choke valve being completely open;

detecting the concentrations of the exhaust gases coming from the engine by an exhaust gas sensor; and controlling the air-fuel ratio by means of only the air-fuel ratio control valve which is actuated on the basis of the output signal only from the exhaust gas sensor so as to control the air flow into the air bleed for mixing the air with the fuel to be sucked into the intake passage, when the engine temperature is higher than said second predetermined value.

9. The method of claim 8 wherein said first predetermined value is about 15° C. and said second predetermined value is about 55° C.

* * * * *